US005573017A

United States Patent [19]

Post

[11] Patent Number: 5,573,017

[45] Date of Patent: Nov. 12, 1996

[54] OPTICAL ORNAMENT

[76] Inventor: James M. Post, 303 N.E. 8th Ave., Gainesville, Fla. 32601

[21] Appl. No.: 507,891

[22] Filed: Jul. 27, 1995

[51] Int. Cl.[6] ..... A45D 8/12

[52] U.S. Cl. ..... 132/275; 362/103; 446/219

[58] Field of Search ..... 132/275; 385/119, 385/33, 35, 901; 362/103, 104, 105, 106; 446/219

[56] References Cited

U.S. PATENT DOCUMENTS

| | | | |
|---|---|---|---|
| 2,933,853 | 4/1960 | Laval, Jr. | 446/219 |
| 3,501,628 | 3/1970 | Madden . | |
| 3,675,005 | 7/1972 | Curiel | 362/103 |
| 3,758,771 | 9/1973 | Frohardt et al. . | |
| 4,655,721 | 4/1987 | Loomis et al. | 446/219 |
| 4,722,582 | 2/1988 | Modone et al. | 385/35 |
| 4,998,186 | 3/1991 | Cocca . | |
| 5,118,319 | 6/1992 | Smith et al. | 446/219 |
| 5,377,287 | 12/1994 | Lee et al. | 385/35 |

*Primary Examiner*—Gene Mancene
*Assistant Examiner*—Pedro Philogene
*Attorney, Agent, or Firm*—Saliwanchik & Saliwanchik

[57] ABSTRACT

An optical ornament is provided wherein optic fibers are attached to a fastener for attaching the ornament to a person's hair, clothing or body or to an object. A plurality of optical fibers are extended outwardly from a portion of the ornament adapted to receive and focus light and are illuminated in the absence of added electrical energy. Decorations such as gemstones, artificial flowers, and the like are provided to decorate the fastener and to color the light transmitted through the fibers from the portion of the ornament adapted to receive and focus light.

10 Claims, 5 Drawing Sheets

Fig. 3A
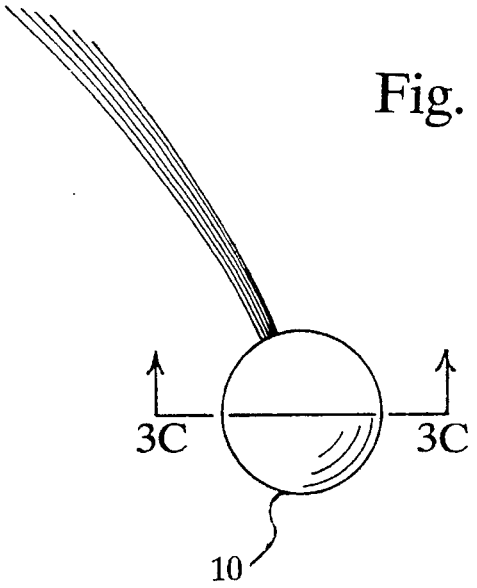
Fig. 3C
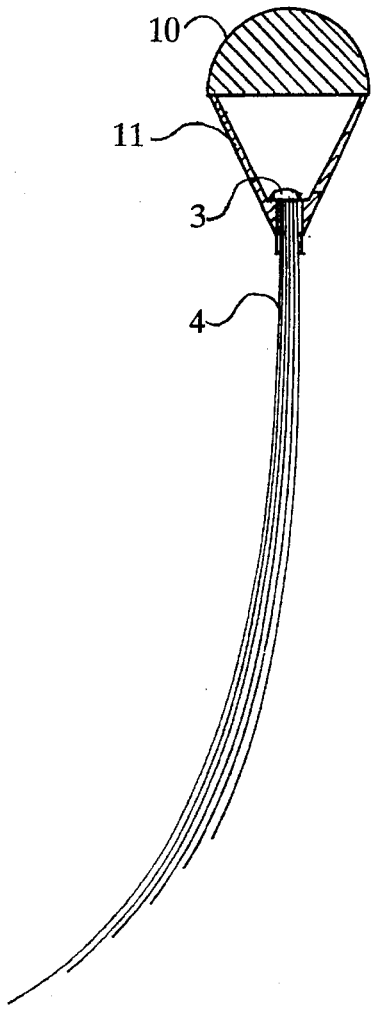
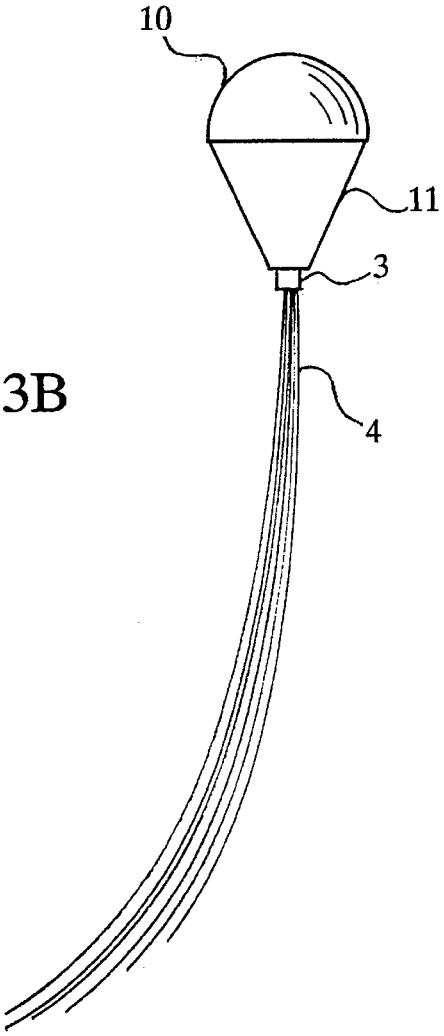
Fig. 3B

OPTICAL ORNAMENT

BACKGROUND OF THE INVENTION

1. Field of the Invention

The invention relates generally to an illuminated ornamental device suitable for decoration of the body, hair, clothing, or toys, preferably utilizing fiber optics as an integral part of the device, requiring no electrical source for its operation.

2. Description of the Prior Art

Hair decorations of many varieties are well known in the art. Such decorations are normally held by hair barrettes, clips, combs, or other variety of means used to temporarily secure ornaments or decorations to the hair.

Specifically, illuminating ornamentation and decorations are also known in the prior art. For example, U.S. Pat. No. 3,501,628, discloses an illuminated hair ornament that provides tiny lamps placed throughout the hair to give an illuminated or sparkling effect. The lamps are operated by a battery housing through the use of concealed wires which are connected thereto. The device tends to be cumbersome and is a problem in that considerable attention must be paid to properly placing the device and the individual lamps in one's hair.

In a similar fashion, the device of U.S. Pat. No. 3,758,771, is used to illuminate a wig through the use of fiber optic members. The light emitting ends of the fibers are interspersed throughout the hair and connect to a miniaturized light source made of a battery, an electric lamp, and a switch. The device is cumbersome and not practical for routine use to decorate the hair.

In U.S. Pat. No. 4,998,186, a decorative hair ornament was described in which a light source was provided for illuminating optical fibers. The light source required provision of electrical energy, such as from a 3.5 V battery. That invention therefore has the attendant problems of having to obscure the electrical source. It also requires replacement of spent electrical sources. The instant invention overcomes these disadvantages.

Accordingly, within the prior art there have been no ornamentation devices that feature an illuminated effect which can be quickly and efficiently attached to the hair. The devices of the prior art, because of their designs, must be very carefully placed in one's hair so as to conceal either wires, a light source, batteries, or a combination of elements that are not intended to be a part of the sought after aesthetic effect.

BRIEF SUMMARY OF THE INVENTION

The instant disclosure describes an invention that provides an illuminated decorative item for a person's head, body or clothing, using fiber optics, (optical fibers). The device is comprised of a light capturing device or panel, such as a lens or a reflecting concentrator such as a parabolic reflector, generally oriented toward the sun or artificial light, a light coupling device or assembly to couple the emitted light into the multiple proximal ends of the radiating optical fibers and a headband, comb, article of clothing, or other item for attachment or proximity to the head, body or clothing. All of the above can be obscured by the hair, clothing or body or displayed. The radiating fibers are dimensioned so that they can be combed into the hair mass, worn as clothing or attached to the body, clothing, shoes, to toys or other objects, or to an animal. Additional features include provisions for varying the color or light either individually or collectively in the optical fibers. Varying light colors can be provided by the inclusion of a splitting prism to provide the colors of the spectrum, or use of colored glass, plastic or the like, and the placement of the proximal ends of the fibers will determine the color.

In use, the fibers are distributed such that the distal ends of the optical fibers are displayed. Light emission takes place only at the distal end of each fiber, creating a point of light.

Accordingly, it is an object of the invention to provide an optical ornamental hairpiece or ornamental device suitable for decoration of the clothing or body or toys requiring no added electrical energy for operation, and which is interesting, attractive and easy to attach.

It is another object of the invention to provide an optical ornamental hairpiece that utilizes optic fibers in a decorative pattern and which requires no added electrical energy for operation.

It is another object of the invention to provide an optical ornamental hairpiece in which the light source for the fiber optics is a light receiving means which is integral to the hairpiece.

It is still another object of the invention, utilizing the principles of focussed natural or artificial illumination, to provide flashing and illuminated eyes for children's toys or sports mascots or hand puppets.

These and other objects are accomplished by an optical ornamental hairpiece utilizing optic fibers. The fibers may be inserted into a protective tubing containing a light receiving means. The light receiving means is adhered to hair fastening means by an adhesive, detachable means, or other convenient means.

Decorative means such as gemstones, flowers, or fabric designs can be provided to decorate the hairpiece combining the fiber optics and hair fastening means.

BRIEF SUMMARY OF THE FIGURES

In accordance with these and other objects which will become apparent hereafter, the invention will now be described with reference to the accompanying drawings in which:

FIG. 3A is a plan view showing an alternate configuration of an ornamental hairpiece in the form of a focussing hemi-sphere and support structure which is constructed in accordance with the invention.

FIG. 3B is an elevational view showing an alternate configuration of an ornamental hairpiece in the form of a focussing hemi-sphere and support structure which is constructed in accordance with the invention.

FIG. 3C is a sectional view, along line 3 C of FIG. 3A, showing an alternate configuration of an ornamental hairpiece in the form of a focussing hemisphere and support structure which is constructed in accordance with the invention.

DETAILED DESCRIPTION OF THE INVENTION

Figure 1A:
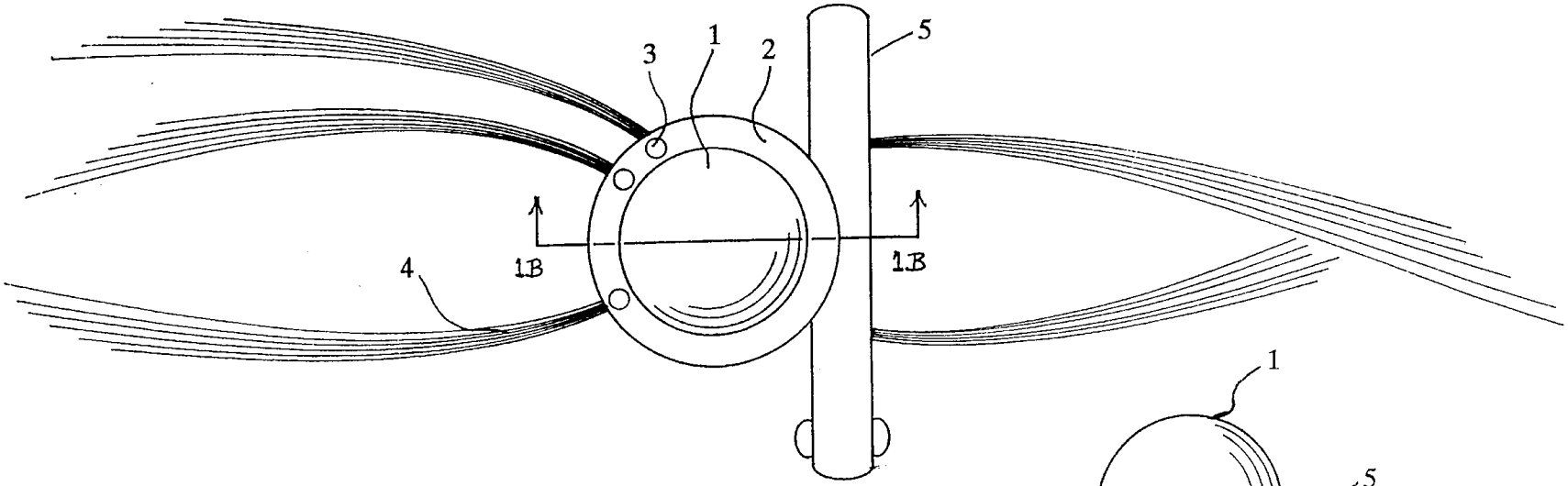
FIG. 1A is a plan showing an optical ornamental hairpiece in the form of a focussing sphere as part of a hair clamp which is constructed in accordance with the invention.
Figure 1C:
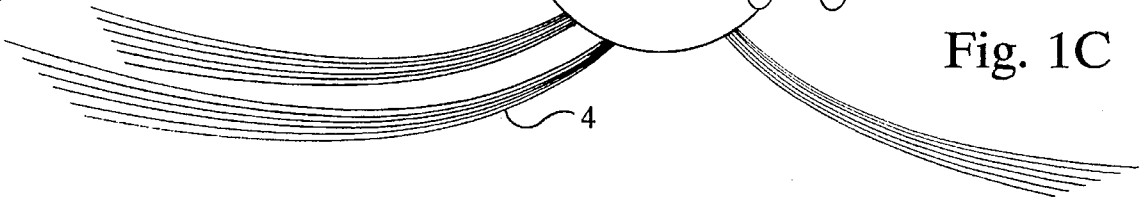
FIG. 1C is an elevational view showing an optical ornamental hairpiece in the form of a focussing sphere as part of a hair clamp which is constructed in accordance with the invention.
Figure 1B:
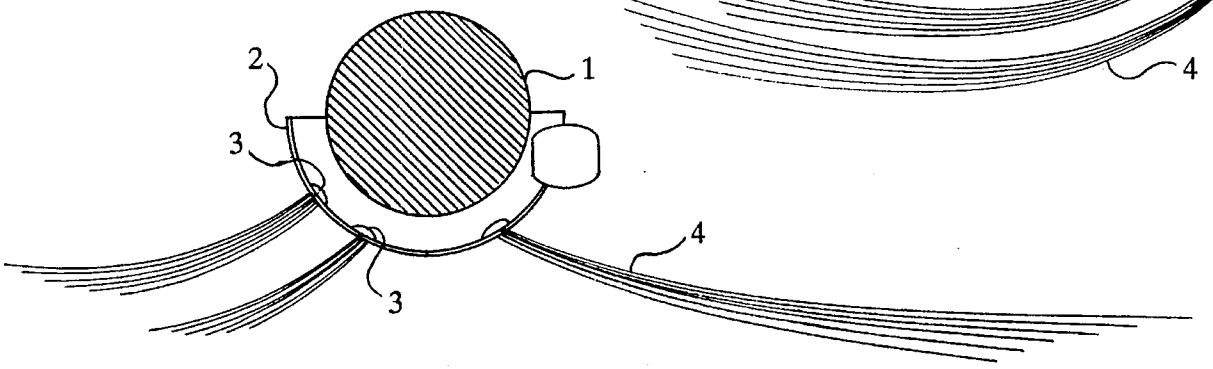
FIG. 1B is a sectional view, along line 1B of FIG. 1A, showing an optical ornamental hairpiece in the form of a focussing sphere as pan of a hair clamp which is constructed in accordance with the invention.

With reference to FIG. 1, a first embodiment of this invention is provided as an ornamental hairpiece comprising a light receiving and focusing means which is shown as a full transparent sphere 1, a housing which acts as a support structure 2, optical fiber support, attachment and light modifying means 3, optical fiber bundle 4 and a fastening means 5 are shown. The fastening means as illustrated is a standard hair clip used in the customary fashion. Other means for attachment are, naturally within the scope of this invention.

In use, it is desirable that any source of light in the surroundings of the wearer be received, captured, concentrated, and directed onto the proximal ends of the optical fibers. The full sphere optical element lends itself to these requirements. Light rays from sources within the upper hemisphere surrounding the wearer are focussed onto a spherical surface defined by the inner surface of support structure 2. As the apparent position of the light source varies, either as a result of actual motion of the light source or as a result of head motion by the wearer, the focussed point of light scans the inner surface of the housing 2. Referring to FIG. 1, it can be observed that optical fiber attachment means 3 is positioned such that the scanning light point intercepts the proximal ends of the fibers and the light is propagated into the fibers. Ideally, the proximal ends of the fibers are situated at or near the focal point of the light receiving and focusing means. Color selection can be accomplished by varying the composition of item 3 by a colored member made of glass, plastic or like light transmissive element. Only three fiber bundles are illustrated for clarity. In practice, many bundles are installed and are selectively illuminated by the scanning point of light. Each bundle can have a different color. The distal ends of the fibers are arranged in the wearers hair and transmit intense flashes of varicolored light as the wearer moves or as a result of head motion.

Figure 2A:
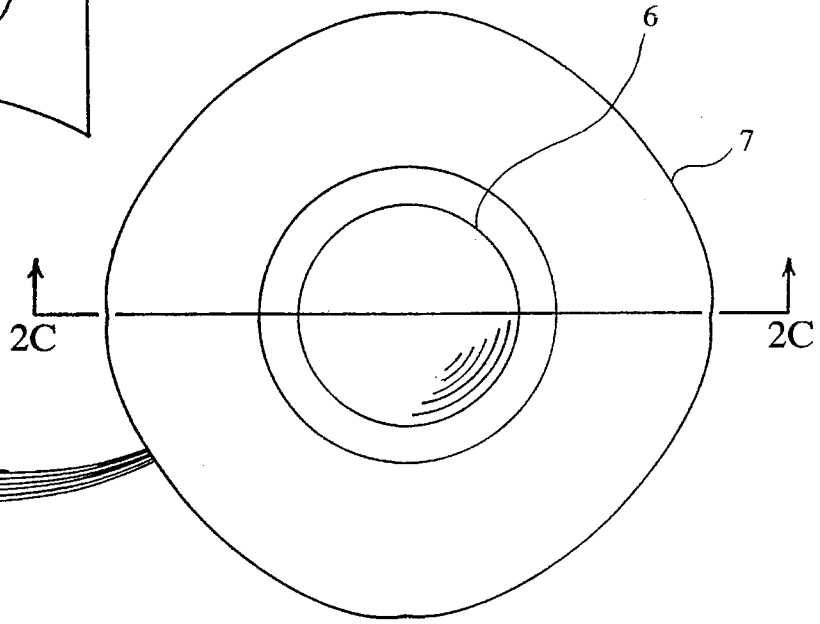
FIG. 2A is a plan view showing an alternate configuration of an ornamental hairpiece in the form of a focussing sphere utilizing a crown-like structure which is constructed in accordance with the invention.
Figure 2B:
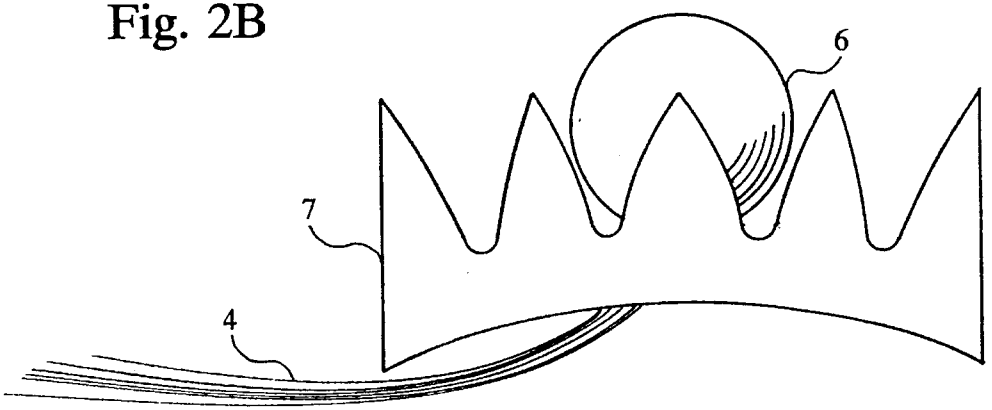
FIG. 2B is an elevational view showing an alternate configuration of an ornamental hairpiece in the form of a focussing sphere utilizing a crown-like structure which is constructed in accordance with the invention.
Figure 2C:
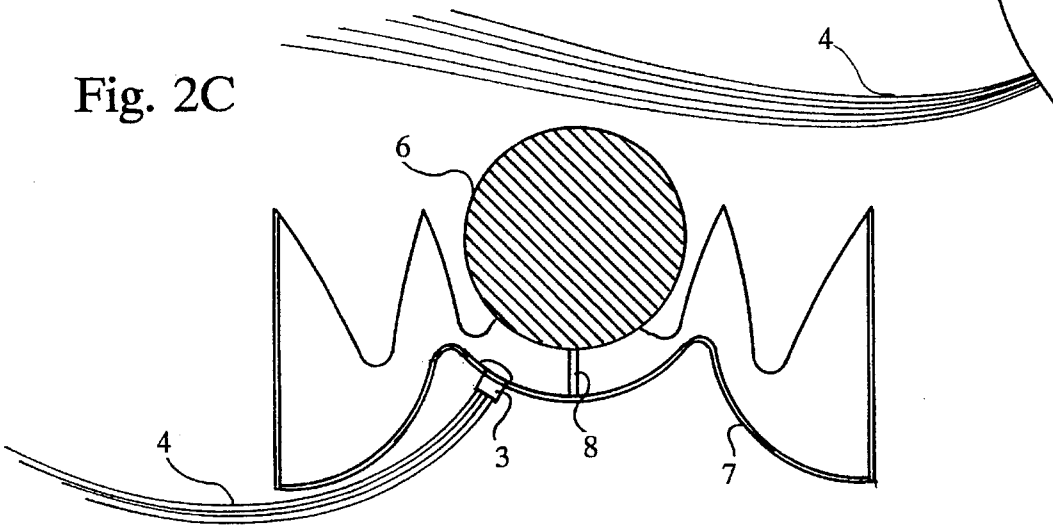
FIG. 2C is a sectional view along line 2C of FIG. 2A showing an alternate configuration of an ornamental hairpiece in the form of a focussing sphere utilizing a crown-like structure which is constructed in accordance with the invention.

With reference to FIG. 2, another embodiment of the ornament comprising a spherical light receiving and focusing lens is shown. Sphere 6, support and decorative crown-shaped housing 7, sphere attachment means 8, fiber bundle 4 and fiber support, attachment and light modifying means 3 are combined as a variation of the basic invention. The entire assembly can be affixed in the wearer's hair by a variety of means, including clips, bands or combs. The shape of the housing 7 may, obviously, be of any decorative shape.

Referring to FIG. 3, a variation of the basic invention is illustrated, using a hemi-sphere for the concentrating optical element. Hemi-sphere 10, housing 11, fiber bundle 4 and fiber support, attachment and light modifying means 3 are combined in accordance with the basic features of this invention. In practice, multiples of the hemi-sphere assembly are combined into one decorative item, with each element optionally radiating different colors. Clusters of the elements shown in FIG. 3 may be combined to form, for example, flower shaped arrangements or any other decorative design for attachment to clothing, hair, toys, or other objects.

Figure 4A:
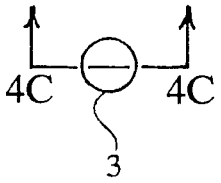
FIG. 4A is a plan view showing an attachment means for holding fiber optic bundles and for providing light modifying means.
Figures 4B, 4C:
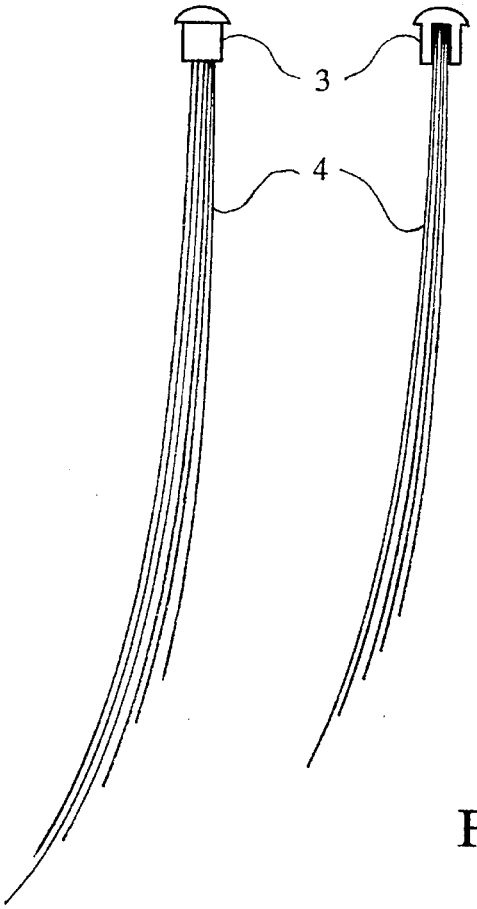
FIG. 4B is an elevational view showing an attachment means for holding fiber optic bundles and for providing light modifying means.
FIG. 4C is a sectional view, along line 4 C of FIG. 4A, showing an attachment means for holding fiber optic bundles and for providing light modifying means.

FIG. 4 illustrates the means 3 for support and attachment of the optical fiber bundles 4 and for modifying the light. A molded plastic shape 3, with integral color is provided, to which the optical fiber is attached with adhesive. The assembly is installed into any appropriate housing such as 2, 7, or 11, as described above.

Figure 5B:
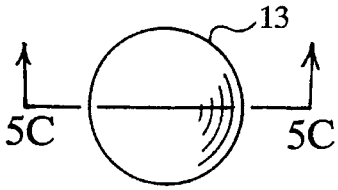
FIG. 5B is a plan view showing interconnected spheres and support structures suitable for providing illuminated eyes for toys, sports mascots and puppets.
Figure 5C:
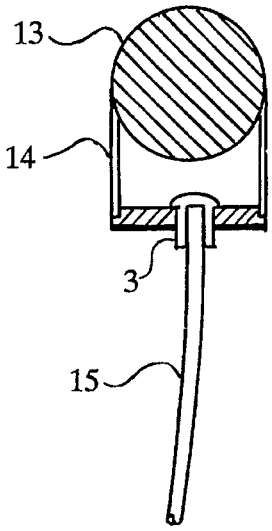
FIG. 5C is a sectional view, along line 5C of FIG. 5B, showing for toys, sports mascots and puppets. interconnected spheres and support structures suitable for providing illuminated eyes

A further variation of the basic invention provides illuminated and flashing eyes for a child's toy, sports mascots, puppets, or other objects. Referring to FIG. 5, two transparent spheres 13 are interconnected via an optical fiber or optical fiber bundles. Sphere 13, support housing structure 14, optical fiber bundle 15 and fiber support, attachment and light modifying means 3 are combined to form an optical device that intercepts light rays, and which concentrates and focuses the rays onto the proximal ends of the optical fiber(s) 15 and redirects the energy out of the assembly. The device performs in either direction, with either sphere acting both as a light receiver or as a light transmitter. FIG. 5D shows a child's toy with the optical ornament of FIG. 5A sewn into the body of the toy to fasten the ornament to the toy. The sewing is achieved by any obvious means, for example by passing sewing thread 16 over and around the optical fiber(s) 15 while also passing the sewing thread through some of the material from which the toy is made or through any stuffing inside the toy.

Figure 5A:
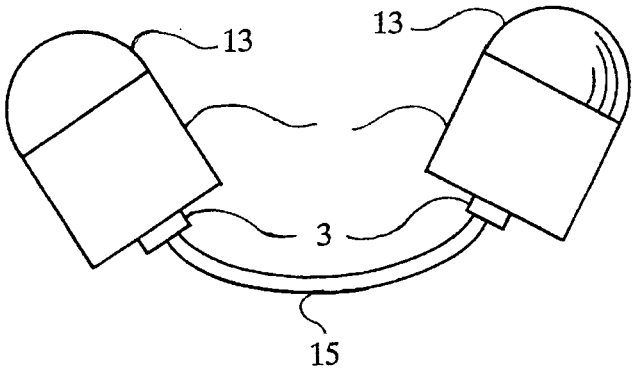
FIG. 5A is an elevational view showing interconnected spheres and support structures suitable for providing illuminated eyes for toys, sports mascots and puppets.
Figure 5D:
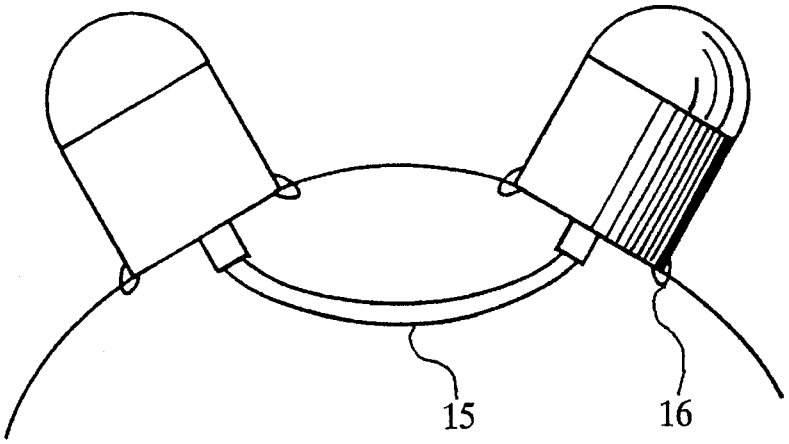
FIG. 5D is a view of a child's toy showing the interconnected spheres and support structure of FIG. 5A as the eyes for a toy and the means of fastening the structure into the toy by sewing the structure into the head of the toy.
Figure 5E:
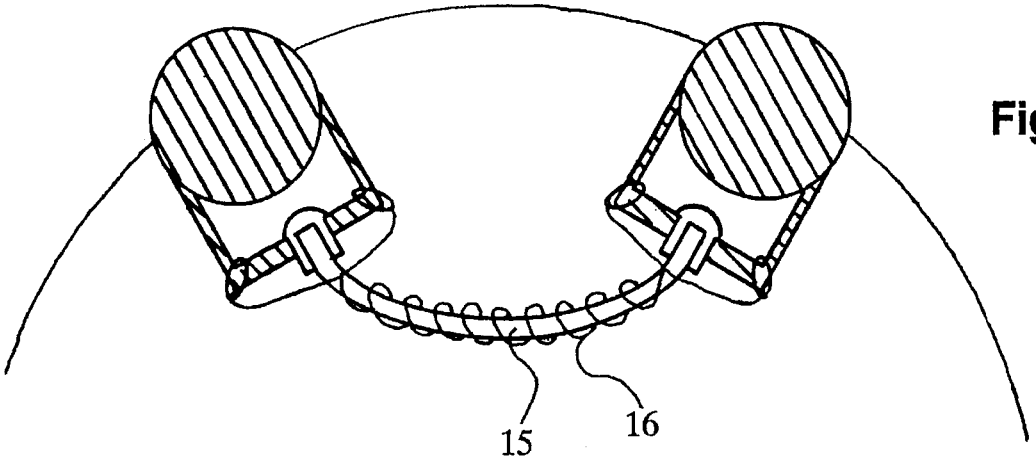
FIG. 5E is a cross-sectional view of the head of a child's toy showing the interconnected spheres and support structure of FIG. 5A as the eyes for a toy and the means for fastening the structure into the toy by sewing the structure into the head of the toy.

FIG. 5E shows the head of a child's toy in cross section with the optical ornament of FIG. 5A shown recessed inside the head of the toy and with thread 16 affixing the fibers 15.

The optical ornament according to this invention may be attached by any fastening means to the body of a person or animal, to clothing, shoes, toys or other objects. Those skilled in the art will appreciate that any fastening means may be used without departing from this invention.

It will be appreciated that a variety of assemblies using various decorative and attachment means can be used in alternative embodiments of the basic invention. The invention can be provided in other forms without departing from the spirit or essential attributes hereof and accordingly, reference should be made to the following claims, rather than to the specifics of the foregoing specification, as indicating the scope of the invention.

REFERENCES

U.S. Pat. No. 3,501,628.

U.S. Pat. No. 3,758,771.

U.S. Pat. No. 4,998,186.

I claim:

1. An optical ornament requiring no added electrical energy for operation comprising:

a) means for fastening the ornament to a person's hair, clothing, shoes, body, to an object, or to an animal;

b) at least one light receiving and focusing means attached to said fastening means in such a way that light in the surroundings of the person, animal, or object to which said ornament is fastened will impinge on and be focused at a focal point by said at least one light receiving and focusing means;

c) at least a single optical fiber attached to said fastening means such that the proximal end(s) of said optical fiber(s) are situated proximate the focal point of said at least one light receiving and focusing means such that focused light enters said proximal end(s) of the optical fiber(s) and is conducted from said proximal end(s) towards the distal end(s) of said optical fiber(s) such that the conducted light emanates from said distal end(s); and d) a housing which acts as a support structure for maintaining said light receiving and focusing means and said optical fibers in appropriate juxtaposition with respect to each other and the light in the surroundings of said person, animal or object to which said ornament is attached so that the light emanating from the distal ends of said optical fibers is displayed.

2. The optical ornament of claim 1 wherein said fastening means is selected from the group consisting of a clip, band, comb and a crown.

3. The optical ornament of claim 1 wherein said light receiving and focusing means is selected from the group consisting of a spherical and a hemi-spherical lens.

4. The optical ornament of claim 1 wherein said optical fibers attached to said fastening means are attached by means of a support, attachment and light modifying means.

5. The optical ornament of claim 4 wherein said support, attachment and light modifying means comprises an adhesive for binding the optical fibers to each other and to said fastening means, and a colored member made of glass, plastic or like material such that light entering said proximal ends of said fibers first passes through said colored member such that light emanating from said distal ends of said fibers has the color of said colored member.

6. The optical ornament of claim 1 which is an ornament for the hair, such that the optical fibers of the ornament when affixed to the hair via said fastening means may be combed into the hair to provide flashes of light as the wearer moves from one place to another or from one head position to another within a lighted surrounding.

7. The optical hair ornament of claim 6 wherein the ends of the optical fibers proximal to the light receiving and focusing means are deployed below a colored member such that light entering said proximal ends of said fibers first passes through said colored member such that light emanating from said distal ends of said fibers has the color of said colored member, resulting in a hair ornament that displays varicolored flashes of light as the wearer moves.

8. The optical ornament of claim 1 when it is incorporated in an object.

9. The optical ornament of claim 1 comprising clusters of optical fiber support, attachment and light modifying means such that said clusters form a decorative design for attachment to a person's body, clothing, shoes, hair, toys, to other objects, or to an animal.

10. An optical ornament in a child's toy requiring no added electrical energy for operation comprising:

a) at least one light receiving and focusing means attached to a fastening means in such a way that light in the surroundings of the child's toy to which said ornament is fastened will impinge on and be focused at a focal point by said at least one light receiving and focusing means;

b) at least a single optical fiber attached to said fastening means such that the proximal end(s) of said optical fiber(s) are situated proximate the focal point of said at least one light receiving and focusing means such that focused light enters said proximal end(s) of the optical fiber(s) and is conducted from said proximal end(s) towards the distal end(s) of said optical fiber(s) such that the conducted light emanates from said distal end(s); and c) a housing which acts as a support structure for maintaining said light receiving and focusing means and said optical fibers in appropriate juxtaposition with respect to each other and the light in the surroundings of said child's toy to which said ornament is attached so that the light emanating from the distal ends of said optical fibers is displayed; wherein said optical ornament forms the eyes of a child's toy, wherein the toy acts as the housing, the light receiving and focusing means act as the eyes of the toy, the optical fiber(s) interconnect the eyes, and the ornament is fastened to the toy by being sewn into the body of the toy.

* * * * *

UNITED STATES PATENT AND TRADEMARK OFFICE
CERTIFICATE OF CORRECTION

PATENT NO. : 5,573,017

DATED : November 12, 1996

INVENTOR(S) : James M. Post

It is certified that error appears in the above-identified patent and that said Letters Patent is hereby corrected as shown below:

Column 3, Line 34, Figure 5C: "is a sectional view, along line 5C of FIG. 5B, showing for toys, sports mascots and puppets. interconnected spheres and support structures suitable for providing illuminated eyes" should read –is a sectional view, along line 5C of Figure 5B, showing interconnected spheres and support structures suitable for providing illuminated eyes for toys, sports mascots and puppets.–

Signed and Sealed this

Eleventh Day of February, 1997

Bruce Lehman

*Attest:*

BRUCE LEHMAN

*Attesting Officer*

*Commissioner of Patents and Trademarks*